United States Patent [19]

Hess

[11] Patent Number: 4,713,864

[45] Date of Patent: Dec. 22, 1987

[54] SEPARABLE FASTENER WITH SLIDING SLEEVE

[76] Inventor: Herman A. Hess, 7601 Bathurst Street, Apt. 1403, Thornhill, Ontario, L4J 4H5, Canada

[21] Appl. No.: 28,798

[22] Filed: Mar. 23, 1987

[51] Int. Cl.[4] ..... A44B 19/00; A44B 11/25

[52] U.S. Cl. ..... 24/590; 24/654; 24/701

[58] Field of Search ..... 24/654, 684, 698, 690, 24/701, 590; 54/53; 128/566

[56] References Cited

U.S. PATENT DOCUMENTS

| | | | |
|---|---|---|---|
| 255,515 | 3/1882 | Kelsey et al. | 24/654 |
| 499,225 | 6/1893 | Hayes | 54/53 |
| 824,544 | 6/1906 | Hossege | 54/53 |
| 844,428 | 2/1907 | Wagner | 24/698 |
| 1,301,855 | 4/1919 | Linhart | 24/690 |
| 1,494,610 | 5/1924 | McGlashan | 24/701 |
| 1,840,896 | 1/1932 | Groh | 24/690 |
| 2,137,564 | 11/1938 | Carlson | 24/590 |
| 3,936,914 | 2/1976 | Mancini | 24/698 |
| 4,502,192 | 3/1985 | Hess | 24/701 |
| 4,524,495 | 6/1985 | Hess | 24/701 |

*Primary Examiner*—Victor N. Sakran
*Attorney, Agent, or Firm*—Sim & McBurney

[57] ABSTRACT

A separable fastener is provided, consisting of a male member with a stem portion and a T-shaped head portion, and a female member in the shape of an elongated body having a tail portion and a forward portion that is bent with respect to the tail portion. The body has an opening adjacent the bent portion, the opening of sufficient length to permit insertion of one arm of the T-shaped head portion of the male member. The bent forward portion of the female member terminates at an edge which interferes with complete passage of the T-shaped head portion through the opening in any but one particular orientation of the male member with respect to the female member. The edge has an indentation which is adapted to receive the T-shaped head portion when the male member is in that particular orientation, thus permitting the avoidance of interference and a complete passage of the T-shaped head portion through the opening. The opening also has a part wide enough to permit swivelling of the stem portion of the male member after passage of the T-shaped head portion through the opening. A sleeve member is mounted on the female member for sliding movement along the elongated body, so that the sleeve member can inhibit the male member from assuming the "release" orientation by lodging between the female member and one of the arms of the male member.

6 Claims, 3 Drawing Figures

SEPARABLE FASTENER WITH SLIDING SLEEVE

This invention relates to improvements in separable fasteners, and has particular reference to a fastener for use with necklaces and similar items of personal adornment.

BACKGROUND OF THIS INVENTION

Currently the most commonly utilized fastener for necklaces and the like consists of a combination of two rings, the one ring being integral and being attached to one end of the necklace or chain, the other ring consisting of a tubular penannular portion defining a gap through which the integral ring can pass, the penannular portion housing a slidable latch portion which is spring biased in such a way that it closes the penannular portion under the urging of the spring. However, the latch portion can be pulled back to allow the integral ring to be passed into or out of engagement with the penannular portion. This conventional fastener works well enough, but is expensive to manufacture and is subject to sticking and breakage due to the moving parts.

A different approach to joining the ends of a garment accessory is illustrated in U.S. Pat. No. 1,840,896, Groh, and in U.S. Pat. No. 499,225, Hayes. Both of these fasteners are intended for use with a belt-like article in which, after connection together, the parts of the fastener are constantly tensioned together. However, the structure of these prior art fasteners, quite similar to each other, is not appropriate for use with a necklace or other loose article of adornment, in which the parts of the fastener are likely to be bounced around and are not under constant tension to keep them together.

The Groh and Hayes prior fasteners are constituted by a T-shaped male member and a female member with a slot through which the male member may be inserted, then rotated, then pulled into tension so that the members cannot be disengaged.

My earlier U.S. Pat. No. 4,502,192, issued Mar. 5, 1985 and entitled "Separable Fastener", utilizes the same basic structure as described above in connection with the Groh and Hayes prior fasteners, but adds an additional improved feature which prevents the parts of the fastener, once engaged, from being simply bounced or jiggled into disengagement. Specifically, my earlier patent provides a separable fastener including a male member having a stem portion and a T-shaped head portion with two arms projecting sidewards from the stem portion, and a female member constituted by an elongated body with a tail portion and a forward portion that is bent with respect to the tail portion. The elongated body of the female member has an opening adjacent the bent forward portion, which opening is of sufficient length to permit the insertion of one arm of the T-shaped head portion of the male member. However, the bent forward portion of the female member terminates at an edge which interferes with complete passage of the T-shaped head portion through the opening in any but one particular orientation of the male member with respect to the female member. That edge has an indentation adapted to receive the T-shaped head portion when it is in said one particular orientation, in order to avoid interference and permit complete passage of the T-shaped head portion through the opening. The opening further has a part wide enough to permit swivelling of the stem portion after passage of the T-shaped head portion through the opening.

GENERAL DESCRIPTION OF THIS INVENTION

I have now discovered that an improved level of security and greater safety can be obtained by adding one further feature to the separable fastener disclosed in my earlier U.S. Pat. No. 4,502,192.

More particularly, the female member is provided with a sleeve member mounted thereon for sliding movement along the elongated body, the sleeve member being adapted to inhibit the male member from assuming the said one particular orientation by lodging between the female member and one of the arms of the male member.

Still more particularly, this invention provides a separable fastener comprising a male member having a stem portion and a T-shaped head portion with two arms projecting sidewards from the stem portion, and a female member constituted by an elongated body with a tail portion and a forward portion that is bent with respect to the tail portion. The elongated body has an opening therethrough adjacent the bent forward portion, the opening being of sufficient length to permit insertion of one arm of the T-shaped head portion of the male member. The bent forward portion of the female member terminates at an edge which interferes with complete passage of the T-shaped head portion of the male member in any but one particular orientation of the male member with respect to the female member, said edge having an indentation adapted to receive the T-shaped head portion when in said one particular orientation in order to avoid interference and permit complete passage of the T-shaped head portion through the opening. The opening further has a part wide enough to permit swivelling of the stem portion after passage of the T-shaped head portion through the opening. The female member has a sleeve member mounted thereon for sliding movement along the elongated body, the sleeve member being adapted to inhibit the male member from assuming said one particular orientation by lodging between the female member and one of the arms of the male member.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
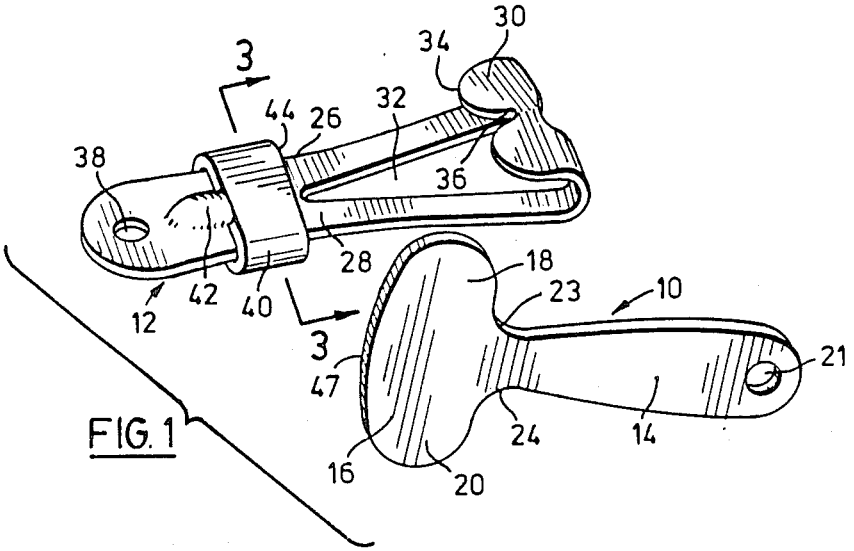
FIG. 1 is a perspective view of the two parts of the separable fastener of this invention, just prior to connection.

Attention is first directed to FIG. 1, which shows a male member 10 and a female member 12. The male member 10 has a stem portion 14 and a T-shaped head portion 16, the head portion 16 having two arms 18 and 20 projecting sidewards from the stem portion 14. It will be seen that the male member is bilaterally symmetrical about a mid-line of symmetry, and that the stem portion 14 has an aperture 21 on the mid-line of symmetry.

At the location of transition between the arms 18 and 20 and the stem portion 14 are two shoulders 23 and 24, which are rounded as can be seen in the figure.

The female member 12 is constituted by an elongated body 26 having a tail portion 28 and a forward portion 30 that is bent with respect to the tail portion 28. More particularly, the forward portion 30 is bent around in a J-shape, as viewed from the side. The elongated body 26 has an opening 32 therethrough adjacent the bent portion 30, the opening 32 being of sufficient length to permit insertion of one arm 18 of the T-shaped head portion 16 of the male member 10. As can be seen, the bent forward portion 30 of the female member 12 terminates at an edge 34 which includes an inward indentation 36.

The female member 12 is bilaterally symmetrical about a mid-line of symmetry, and both the opening 32 and the indentation 36 are located on that mid-line of symmetry. The tail portion 28 has an aperture 38 also on the mid-line of symmetry.

If the indentation 36 were absent on the edge 34, it would not be possible to insert the male member 10 fully through the opening 32, due to mechanical interference between the male member 10 and the edge 34. However, the provision of the indentation 36 allows the male member 10 to be pushed through the opening 32, so long as the male member 10 registers with and is received within the indentation 36 during the last portion of its passage.

The various stages of the insertion of the male member 10 through the opening 32 of the female member 12 are described in my earlier U.S. Pat. No. 4,502,192.

After the head 16 of the male member 10 has passed through the opening 32, the male member 10 can be swivelled through approximately 90° due to the fact that the opening 32 has a part adjacent the bent portion 30 which is large enough to permit the swivelling. After swivelling, the male and female members will be in an aligned and engaged position, such that the shoulders 23 and 24 are received snugly in the J-shape defined by the bent portion 30 of the female member 12. In this position, the stem portion 14 of the male member 10 and the tail portion 28 of the female member 12 will be parallel and approximately in the same plane.

When in this condition, the chances of the two members being jiggled or bounced loose when they are connecting the ends of a chain or necklace are extremely small, for the reason that the male member 10 would have to take up precisely the position in which it is engaged with the indentation 36, with one of the arms already partly through the opening 32. Any other configuration would not allow disengagement. The likelihood of the male member 10 taking up this position purely by chance through jiggling or bouncing is extremely remote.

To make the likelihood of disengagement even smaller, this invention provides a sliding sleeve member 40 which is loosely mounted to the extent that it can reciprocate longitudinally of the tail portion 28. This movement is limited in the rearward sense by an upset protuberance 42 which is stamped into the tail portion 28, and limited in the forward sense simply by the gradually increasing width of the tail portion 28 in the direction toward the bent forward portion 30. When the sleeve member is in its furthest rearward position, i.e. abutting the detent 42, its forward edge 44 is in substantial alignment with the furthest rearward point of the opening 32. This means that the sleeve member 40 if it moves at all, will move in the direction to decrease the span of the opening 32. It can be visualized that, if the male member 10 were in engagement with the female member 12, and were being jiggled or bounced around, the sleeve member 40 would be likely to take up some position other than one in which it is in abutment with the detent 42. This means that it would be moved forwardly with respect to the tail portion 28, and would tend to get in the way of an attempt by the head 16 of the male member 10 to find its "release" position. In other words, the sleeve member 40 would tend to lodge between the female member 12 and one or other of the arms 18, 20 of the male member 10, thus preventing the arm in question from aligning itself with and passing into and through the opening 32.

Figure 2:
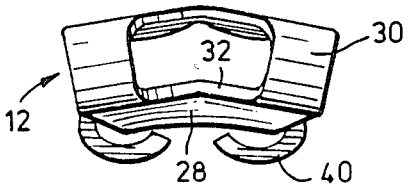
FIG. 2 is an end view of the female member.

I have also found it helpful to bend the forward end of the female member 12 in such a way that, when seen end-on as in FIG. 2, the side portions tend to slope downwardly and outwardly away from each other.

It will be noted that the opening 32 is elongated, of V-shape, and converges away from the bent forward portion 30. This is in accordance with my earlier U.S. Pat. No. 4,502,192.

It will further be noted that the outer edge 47 of the T-shaped head portion 16 of the male member 10 is rounded.

Figure 3:
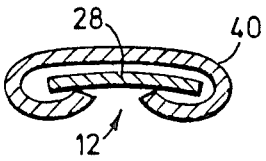
FIG. 3 is a sectional view through the female member, taken at the line 3—3 in FIG. 1.

In addition to the cross-sectional shape of the sleeve member 40 shown in FIG. 3, it will be appreciated that this member could also be made from a piece of tubing that is simply flattened after it has been slipped past the detent 42. It will further be appreciated that the sleeve member 40 could be spring-biased in the forward (rightward) direction as pictured in FIG. 1, thus urging it continuously toward a position in which it lodges between the female member 12 and one or other of the arms 18, 20 of the male member 10.

While one embodiment of this invention has been illustrated in the accompanying drawings, and described hereinabove, it will be evident to those skilled in the art that changes and modifications may be made therein, without departing from the essence of this invention as set forth in the appended claims.

What I claim is:

1. A separable fastener comprising:

a male member having a stem portion and a T-shaped head portion with two arms projecting sidewards from the stem portion, and a female member constituted by an elongated body with a tail portion and a forward portion that is bent with respect to the tail portion, the elongated body having an opening therethrough adjacent the bent forward portion, the opening being of sufficient length to permit insertion of one arm of the T-shaped head portion of the male member, said bent forward portion of the female member terminating at an edge which interferes with complete passage of the T-shaped head portion of the male member in any but one particular orientation of the male member with respect to the female member, said edge having an indentation adapted to receive the T-shaped head portion when in said one particular orientation in order to avoid interference and permit complete passage of the T-shaped head portion through the opening, the opening further having a part wide enough to permit swivelling of the stem portion after passage of the T-shaped head portion through the opening, the female member having a sleeve member mounted on the tail portion thereof for sliding movement along said tail portion, the sleeve member at all times embracing only said tail portion, the sleeve member being adapted to inhibit the male member from assuming said one particular orientation by partly obscuring said opening and lodging between the female member and one of the arms of the male member.

2. The invention claimed in claim 1, in which the female member has an integral detent means which prevents the sleeve member from sliding away from the bent forward portion past a position in which it just clears said opening.

3. The invention claimed in claim 2, in which said opening is elongated, of V-shape, and converges away from said bent forward portion.

4. The invention claimed in claim 1, in which both members are bilaterally symmetrical, the said indentation being on the mid-line of symmetry of the female member.

5. The invention claimed in claim 1, in which the outer edge of the T-shaped head portion remote from the stem portion is rounded.

6. The invention claimed in claim 1, in which the bent forward portion defines a J-shape seen in side elevation, and in which the short leg of the J, seen in end elevation, slopes downwardly and outwardly to either side.

* * * * *